US012428180B2

(12) United States Patent
Biondi et al.

(10) Patent No.: US 12,428,180 B2
(45) Date of Patent: Sep. 30, 2025

(54) APPARATUS AND METHOD FOR TRANSPORTING PRODUCTS

(71) Applicant: G.D S.P.A., Bologna (IT)

(72) Inventors: Andrea Biondi, Bologna (IT); Umberto Zanetti, Bologna (IT); Enrico Campagnoli, Bologna (IT); Luca Cavazza, Bologna (IT)

(73) Assignee: G.D S.P.A., Bologna (IT)

( * ) Notice: Subject to any disclaimer, the term of this patent is extended or adjusted under 35 U.S.C. 154(b) by 50 days.

(21) Appl. No.: 18/554,249

(22) PCT Filed: Apr. 6, 2022

(86) PCT No.: PCT/IB2022/053215
§ 371 (c)(1),
(2) Date: Oct. 6, 2023

(87) PCT Pub. No.: WO2022/214994
PCT Pub. Date: Oct. 13, 2022

(65) Prior Publication Data

US 2024/0116660 A1 Apr. 11, 2024

(30) Foreign Application Priority Data

Apr. 8, 2021 (IT) ..... 102021000008756

(51) Int. Cl.
*B65B 5/06* (2006.01)
*B65B 35/38* (2006.01)
*B65B 35/44* (2006.01)

(52) U.S. Cl.
CPC ..... *B65B 5/06* (2013.01); *B65B 35/38* (2013.01); *B65B 35/44* (2013.01)

(58) Field of Classification Search
CPC ..... B65B 5/06; B65B 35/38; B65B 35/44
See application file for complete search history.

(56) References Cited

U.S. PATENT DOCUMENTS 4,863,008 A * 9/1989 Doi ..... B65B 23/06 198/418.6
11,613,389 B2 * 3/2023 Lebel ..... B65B 5/106 53/55

(Continued)

FOREIGN PATENT DOCUMENTS

EP 2465783 A1 6/2012
EP 3002224 A1 4/2016

(Continued)

*Primary Examiner* — Thanh K Truong
*Assistant Examiner* — Nicholas E Igbokwe
(74) *Attorney, Agent, or Firm* — Carmel Patent Agency; Robert Ballarini

(57) ABSTRACT

A transporter apparatus for products includes a first conveyor, provided with seats for receiving said products and provided to move said products in a first advance direction, a compaction unit, positioned downstream of the first conveyor and a second conveyor positioned downstream of said compaction unit.

The compacting unit includes a support surface on which the products coming from the first conveyor are deposited, and a movement member provided to move the products placed on the support surface towards each other in a second advance direction, so as to form compact columns of products substantially parallel to the second advance direction.

14 Claims, 4 Drawing Sheets

(56) References Cited

U.S. PATENT DOCUMENTS

| | | | | |
|---|---|---|---|---|
| 2002/0134056 | A1* | 9/2002 | Dimario | B65B 5/101 53/64 |
| 2003/0234156 | A1* | 12/2003 | Schoeneck | B65G 47/29 198/419.1 |
| 2011/0023417 | A1* | 2/2011 | Finkowski | B65B 47/04 53/531 |
| 2015/0321857 | A1* | 11/2015 | Sacchetti | B65G 47/845 198/419.2 |
| 2017/0059494 | A1* | 3/2017 | Powell | G01N 23/10 |
| 2018/0134425 | A1* | 5/2018 | Grassi | B65B 11/04 |
| 2021/0114817 | A1* | 4/2021 | Choplin | B65G 47/088 |

FOREIGN PATENT DOCUMENTS

| | | | | |
|---|---|---|---|---|
| EP | 3359451 | A1 | 8/2018 | |
| EP | 3511254 | A1 | 7/2019 | |
| IT | MI20102128 | A1 | 5/2012 | |
| WO | 2010007633 | A1 | 1/2010 | |
| WO | 2017060768 | A1 | 4/2017 | |
| WO | WO-2018167437 | A1 * | 9/2018 | B65G 47/088 |
| WO | 2018203208 | A1 | 11/2018 | |

* cited by examiner

APPARATUS AND METHOD FOR TRANSPORTING PRODUCTS

FIELD OF THE INVENTION

The present invention relates to an apparatus and a method for transporting products, in which, within an industrial production plant, the products being processed are advantageously repositioned so as to adjust any configuration defects resulting from previous processing.

The present invention preferably applies, though not exclusively, to the field of preparing and packaging products for food use and not, an example of which is represented by capsules for brewing beverages, such as coffee, a product to which reference will be made hereinafter without losing generality.

BACKGROUND

In this technical sector, production and packaging apparatuses are known in which a plurality of empty capsules are individually filled with the product to be packaged, such as coffee powder, and then, after being closed by an appropriate membrane, are sent to the final steps of packing into boxes and packaging.

In particular, the packing step often provides placing the capsules inside the boxes according to a predefined ordered configuration, so as to optimise the space occupied by the capsules inside the boxes, as well as to give the final package a neat and tidy appearance which is generally appreciated by customers.

SUMMARY

In the present description as well as in the claims enclosed thereto, certain terms and expressions are deemed to have, unless otherwise expressly indicated, the meaning set forth in the following definitions.

The term "product" means any object within an industrial production and/or packaging line that can be picked up, moved and deposited in a box.

The products are preferably equal to each other, but may also differ in some characteristics such as form, composition or colour.

Products can be, for example, food or sweets already packed in individual containers or wrappers, such as coffee capsules or other brewing beverages, bottles and cartons of beverages, yoghurt pots, individual chocolates (wrapped or naked), candies, small boxes, pouches containing solid, liquid or semi-solid food products; also, ceramic industry products, sanitary napkins, products of the tobacco industry, cosmetic industry products, pharmaceutical industry products, personal & home care industry products.

The term "box" means any container suitable for containing products, in particular any container suitable for packaging products to be subsequently marketed. Preferably the box is intended to contain a plurality of products in an ordered configuration. The box is preferably made of cardboard and has a closable lid, but other configurations and materials can be provided.

"Configuration" of a plurality of products means the arrangement of the products in space, referring in particular to their mutual positioning and orientation in space.

A configuration is said to be "ordered" when the products, in a certain position of the packaging apparatus, maintain a predefined spatial arrangement, preferably constant over time.

In a plurality of products, it is understood that products are moved "towards each other" when the distance between the products is reduced as a result of a relative motion between the products. Preferably, products are moved "towards each other" as they are moved in a same direction, so that the products that follow reduce the distance from the products preceding them.

In a plurality of products moved within the packaging apparatus along an advance direction, one or more "columns" of products and/or one or more "rows" of products may be identified, where a "column" of products is defined as a plurality of products aligned with each other substantially parallel to the advance direction, and a "row" of products is defined as a plurality of products aligned with each other substantially perpendicularly to the advance direction.

The advance direction may be substantially rectilinear or curved.

In a column or a row, products may be spaced apart from, or in contact with each other.

A column or row is considered as "compact" when in that column or row the products are substantially close to each other, so that the distance between adjacent products is zero (mutually contacting products) or substantially reduced, in any case lower than the size of one product. In other words, the potential distance between adjacent products must be zero or negligible, so that there is no space between them to insert another product.

In a row or column of products in an ordered configuration, a "gap" is present when the respective product is missing in one position of said ordered configuration.

A "support surface" may be any surface on which products can be placed during their production and/or packaging process. Preferably the surface is a plane surface, however it is envisaged that it may also be curved, preferably slightly curved.

The support surface is considered as "substantially horizontal" when it has an inclination with respect to the horizontal plane, where a "horizontal plane" is a plane substantially perpendicular to a vertical direction defined by the direction of the force of gravity, lower than an angle of 15°, preferably lower than an angle of 10°.

Preferably, the inclination of a substantially horizontal support surface is such that products do not slide when placed thereon.

With reference to an advance direction of products on a support surface, the "discharge end" of the support surface is defined as the end towards which the products are directed in their movement along the advance direction.

"Conveyor" means any device or member capable of moving products along a predefined trajectory while maintaining the configuration of the products in a somewhat ordered configuration. Examples of conveyors may be conveyor belts with or without seats, or an inclined guide or a robotic arm.

The Applicant has preliminarily observed that the lack of one or more products being supplied to a packaging apparatus may result in a defective number of products being placed in the box, compromising the quality of the final package, which must necessarily be discarded.

This results in a consequent loss of production and a possible need for the operator to retrieve the products within the discarded box and return them to the production process.

The Applicant observed that this undesirable event occurs more frequently when a predefined number of goods must be in the box, in particular, when that predefined number of goods must be placed inside a box in a predefined ordered configuration.

On the other hand, the Applicant observed that, in the production step, it is not unusual for one or more products within an ordered group of products to be missing or to have to be discarded before being placed in a box due to lack of compliance with certain production specifications.

Such cases may occur, for example, in high-capacity production lines where processing is carried out simultaneously (or almost simultaneously) on a plurality of products using a corresponding plurality of identical working devices when one or more of these devices does not work properly.

For example, in a first type of production installation, which is particularly widespread, it is provided that products, e.g. coffee capsules, are moved along an advance direction between the various workstations on a multi-track conveyor where the products are individually received within seats arranged in rows parallel to each other and perpendicular to the advance direction. When a row of products arrives at a workstation, e.g. a filling station or a closing station, each product in the row is committed to a respective working device, and if one of these devices fails to work properly for any reason, the product leaving that device will be discarded. In this way, a "gap" (or, in other words, a "hole") is created in the row of products being processed which, however, will continue the respective processing and packaging process, where, as mentioned above, it could result in defects in filling the final box.

Moreover, the Applicant observed that, in general, the presence of a gap in an ordered configuration may lead to production problems even at the workstations following the one where it originated, even before reaching the final step of packaging in a box.

The Applicant has therefore perceived that, in order to avoid that possible gaps of products formed within a production and/or packaging installation may negatively affect subsequent operations, it is necessary to provide, while transporting the products between two generic operating units, a step of compacting the products that restores the desired ordered configuration by filling the possible gaps of products formed in the previous stations.

Finally, the Applicant has found that a product transporter apparatus in which a product compaction unit is interposed between a first and a second conveyor, comprising a support surface for the products and a movement member moving the products of each column one next to the other in an advance direction, makes it possible to obtain compact columns of products without gaps.

Therefore, the present invention, in a first aspect thereof, relates to a transporter apparatus for products comprising a first conveyor, a compaction unit positioned downstream of said first conveyor and a second conveyor positioned downstream of said compaction unit.

Preferably, said first conveyor is arranged to move said products in a first advance direction.

Preferably, on said first conveyor a plurality of suitable seats are defined to receive said products.

Preferably, said compaction unit comprises a support surface arranged to receive said products from said first conveyor.

Preferably, said compaction unit comprises a movement member associated with said support surface and arranged to move products resting on said support surface towards each other in a second advance direction, thereby forming compact columns of products substantially parallel to said second advance direction.

Preferably, said second conveyor is designed to receive said compact columns of products and move them in a third movement direction.

Due to the above-mentioned features, the transporter apparatus of the invention is able to induce a relative motion between products arranged on a support surface so that the products are moved towards each other in an advance direction. This makes it possible to advantageously fill possible product gaps present in the product configuration of the first conveyor and to supply the second conveyor with subsequent rows of products without gaps.

The Applicant has in fact ascertained that, in this way, the gaps are advantageously moved to the rear of the columns advancing on the support surface, while keeping the front rows of products always complete. In other words, possible gaps within the individual column are transformed into a shorter column length, which can in turn be compensated for by the arrival of subsequent products.

Such gap movement may be continuous or discontinuous, depending on the operating modes of the movement member, and may in general be modulated according to process requirements.

The Applicant has also ascertained that such method is particularly effective in absorbing the gaps that are created in a substantially statistical manner within the ordered configuration of products. Such gaps may be due to random errors in the working devices upstream of the first conveyor and are therefore randomly distributed between the different product columns. In this way, the average number of gaps present in the different columns of products remains substantially the same over sufficiently long periods of time, and consequently, the length of the different columns of products remains substantially constant.

The present invention, in a second aspect thereof, relates to a method for transporting products in an apparatus for producing and/or packaging said products.

Preferably, said method comprises the step of arranging said products inside seats which are provided on a first conveyor.

Preferably, said method comprises the step of moving said products in a first advance direction of said first conveyor.

Preferably, said method comprises the step of transferring a plurality of said products from said seats and depositing them on a support surface.

Preferably, said support surface is substantially horizontal.

Preferably, said plurality of products is arranged on said support surface in columns which are substantially parallel to a second advance direction.

Preferably, said method comprises the step of applying a force to said products so as to move them on said support surface towards each other in said second advance direction, so as to form a plurality of compact columns of products.

Preferably, said method comprises the step of receiving said compact columns of products and moving them in a third advance direction.

Thanks to the method of the invention, it is therefore possible to solve the drawbacks arising from the presence of gaps within an ordered configuration of products that must be moved within an industrial production or packaging installation.

In fact, the products, while on the support surface, are moved to form compact columns before being delivered to a second conveyor, which is arranged to receive them and keep them in a compact form so that they can be conveniently processed according to production or packaging requirements. In this way, waste and production losses caused directly or indirectly by one or more product gaps in an ordered configuration are substantially reduced or eliminated.

The present invention, in a third aspect thereof, relates to a system for producing and/or packaging products comprising a transporter apparatus made according to the first aspect.

Preferably, this installation comprises an apparatus for packaging said products positioned downstream of a production apparatus for said products.

Preferably, said transporter apparatus is interposed between said production apparatus and said packaging apparatus.

In some embodiments, said transporter apparatus is provided within said production apparatus, preferably between two workstations of said production apparatus.

In at least one of the above aspects, the present invention may also have at least one of the preferred features set out hereinafter.

In some embodiments said movement member is configured to move said support surface between a first operating position, in which said support surface is substantially horizontal, and a second operating position, in which said support surface is inclined with respect to a horizontal plane.

Thanks to this feature, the products are slided in the advance direction in such a way that they are next to each other within the individual columns, by simply using the force of gravity.

This makes the operation easy to apply and globally cost-effective.

In addition, the degree of inclination may be varied to adequately balance the need for operation speed and the need to limit the force of impact between products while avoiding possible damage to the products. In addition, the degree of inclination may be easily adapted to the characteristics of the products and their ability to slide on the support surface.

In alternative embodiments, said movement member may comprise a plurality of nozzles connected to a pneumatic circuit and suitably directed to move the products along the second advance direction by air jets, or one or more drive belts configured to engage the products of a column and push them along the support surface parallel to the second advance direction.

Preferably, in said second operating position said support surface is inclined with respect to a horizontal plane by an angle greater than 30°, more preferably greater than 60°.

In an embodiment, said support surface is moved between said first and said second position by being pivoted about a rotation axis which is defined at a discharge end of said support surface.

Furthermore, it is preferred that said products are moved on said support surface in said second advance direction by inclining said support surface towards said discharge end.

In this way, the support surface may be inclined while keeping the discharge end and, in particular, its connection with the second conveyor, substantially fixed.

Preferably, said second advance direction is substantially parallel to a direction of maximum slope of said support surface when it is inclined in said second position.

In this way, the movement of the products in the advance direction is more effective.

Furthermore, said rotation axis of said support surface is preferably substantially perpendicular to said second advance direction.

In some embodiments, in said first conveyor, each of said seats is arranged to receive one of said products.

In this way, the position of each individual product on said first conveyor is precisely defined so as to facilitate the full effectiveness of the processing to be carried out thereon.

In some embodiments, in said first conveyor said seats are arranged in a plurality of rows which are substantially perpendicular to said first advance direction.

In a preferred embodiment, said rows may be staggered from each other.

Preferably, in said first conveyor said seats are arranged on a plurality of columns which are parallel to said first advance direction.

In some embodiments, a gripping device is provided to take said products from said first conveyor and deposit them on said support surface.

Preferably, said gripping device comprises a plurality of gripping elements arranged to individually take said products from said first conveyor.

In some embodiments, on said support surface, a plurality of channels are obtained, each of which is formed to receive a single column of said products.

In this way, arranging the products in separate columns and keeping such arrangement when moving the products in the second advance direction are made easier, even during the step of compacting products.

Preferably, said channels are parallel to said second advance direction.

In this way, the products are effectively guided in their movement in the second advance direction, which, in fact, remains defined by the longitudinal development of the channels.

Preferably, said channels extend to said discharge end.

In some embodiments, said second conveyor comprises a plurality of guides, each arranged to receive one of said compact columns of products.

In some embodiments, said plurality of guides supplies a device for packing said products.

In alternative embodiments, said second conveyor is of the multi-track type, with a plurality of seats in which the products leaving the compaction unit are individually placed.

In this way, it is possible to supply a packing device or a transporter of the multi-track type with subsequent rows of products that are always free from gaps.

In one embodiment, said products are capsules for brewing beverages, preferably coffee capsules.

BRIEF DESCRIPTION OF THE DRAWINGS

The characteristics and advantages of the invention will become clearer from the detailed description of a preferred embodiment thereof, shown by way of non-limiting example, with reference to the appended drawings, wherein.

DETAILED DESCRIPTION OF THE PREFERRED EMBODIMENTS

Figure 1:
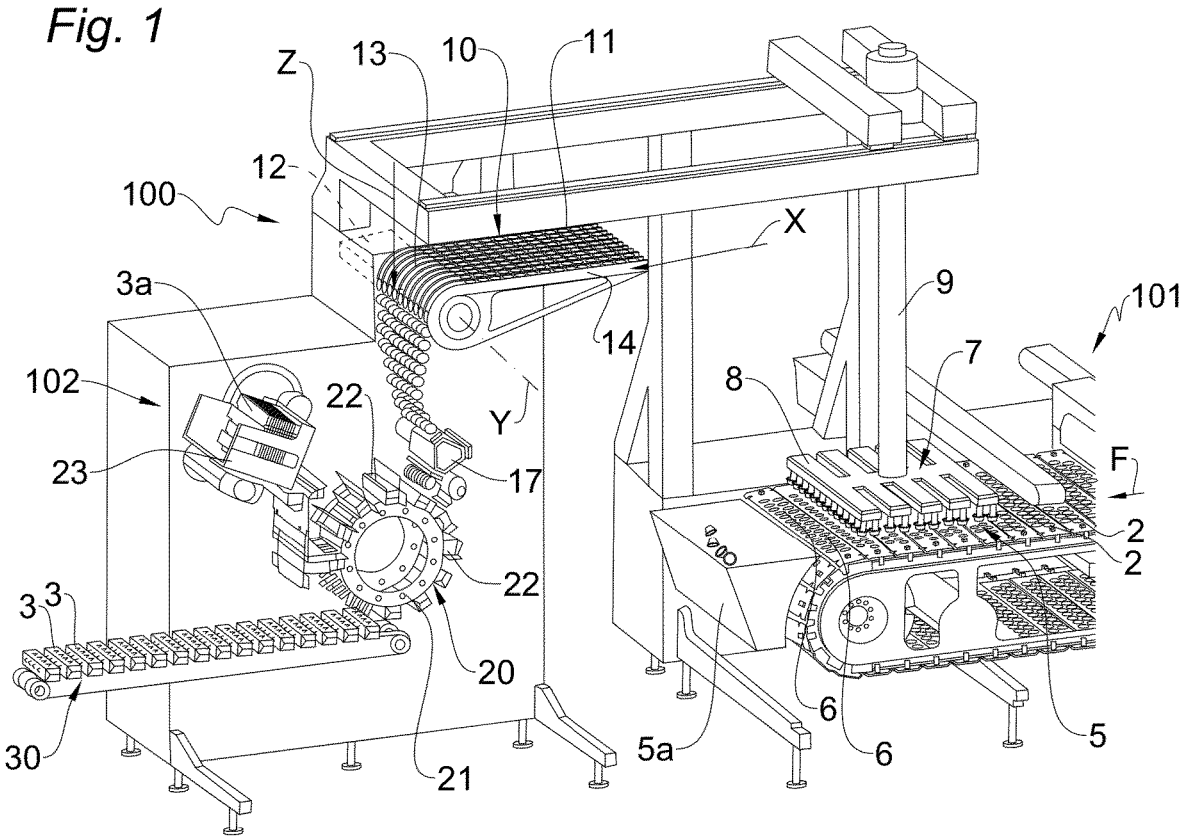
FIG. 1 is a side perspective schematic view of a plant for producing and packaging products in boxes, comprising a transporter apparatus made according to the present invention.

With reference to the enclosed figures, 1 globally refers to a transporter apparatus of products 2, made according to the present invention.

The transporter apparatus 1 is preferably inserted within a production and packaging installation 100 comprising a production apparatus 101, configured for producing products 2, and a packaging apparatus 102, arranged for packaging the products 2 in boxes 3.

In particular, the transporter apparatus 1 is substantially interposed between the production apparatus 101 and the packaging apparatus 102.

In the embodiment described herein, the installation 100 is arranged for the production and packaging of coffee capsules, which thus constitute the products 2 and will be hereinafter referred to by that numerical reference.

Figure 6:
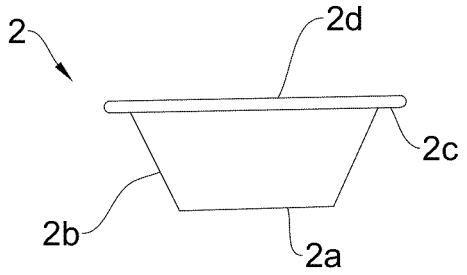
FIG. 6 is a schematic frontal elevation and enlarged scale view of a product obtained in the production and packaging installation of FIG. 1, FIGS. 7 and 8 are side perspective and enlarged scale views of a portion of the transporter apparatus of FIG. 1, in different operating positions respectively.

Referring in particular to FIG. 6, the capsules 2 are substantially identical to each other and comprise a semi-rigid container, e.g. made of plastic material, suitable for containing coffee powder. In this embodiment, the container has a truncated-conical form with a support base 2*a* from which a side wall 2*b* is erected which is flared towards an upper opening, which, in turn, is perimetrically delimited by a protruding edge 2*c* and is closed by a membrane coupled to such edge. The membrane and protruding edge 2*c* define a head 2*d* of the capsule 2, which is axially opposed and substantially parallel to the support base 2*a*.

Obviously, the capsules 2 may be made from different materials and in different forms, depending on their specific use.

The transporter apparatus 1, in its main components, comprises a first conveyor 5, arranged to move the capsules 2 in a first advance direction F, a compaction unit 10 and a second conveyor 16.

The first conveyor 5 runs through the production apparatus 101 and moves the capsules 2 between its various workstations, which for example comprise a filling station, in which the capsules 2 are filled with coffee powder, and a closing station, in which the capsules 2, containing the coffee powder, are closed with a membrane coupled, for example by welding, at the respective protruding edge. These workstations are conventional in themselves and are therefore not represented in detail in the enclosed figures.

In particular, the first conveyor 5 is of the multi-track type and comprises a plurality of seats 6 arranged in subsequent rows substantially perpendicular to the first advance direction F, where each seat is formed to receive a single capsule 2.

In the end region of the first conveyor 5, the capsules 2 are ready to be transferred to the packaging apparatus 102 to be duly packed.

The latter, in its main components, comprises a box forming and filling unit 20 and a transporter 30 that transports the filled and packaged boxes towards possible subsequent stations responsible for their final packaging before being dispatched.

The transporter apparatus 1 further comprises a pick-up device 7, arranged to take the capsules 2 from the first conveyor 5 and deposit them on the compaction unit 10.

In particular, the pick-up device 7 comprises a gripping head 8 on which a plurality of gripping elements 8*a* is mounted, for example of the suction cup type, which are arranged to engage and hold, by coupling, the individual capsules 2 transported by the conveyor 5 at the respective heads 2*d*.

The gripping head 8 is mounted at the end of an arm 9 and is able to move vertically and horizontally as well as to rotate about its longitudinal axis.

The compaction unit 10 comprises a plate 14, on which a preferably planar support surface 11 is defined, which is arranged to receive the capsules 2 deposited by the pick-up device 7, as well as a movement member 12, arranged to move the capsules 2 resting on the support surface 11 towards each other in a second advance direction X towards a discharge end 13 of the support surface 11.

Advantageously, channels 15 are obtained on the plate 14, which are substantially parallel to the second advance direction X and equally spaced apart from each other, within which the capsules 2 are received and guided in their movement towards the discharge end 13. Each channel 15 extends to the discharge end 13 and is formed to receive a single row of capsules 2 able to slide therein.

The second advance direction X is substantially defined by the channels 15 which is substantially rectilinear and parallel to the support surface 11.

Figure 5:
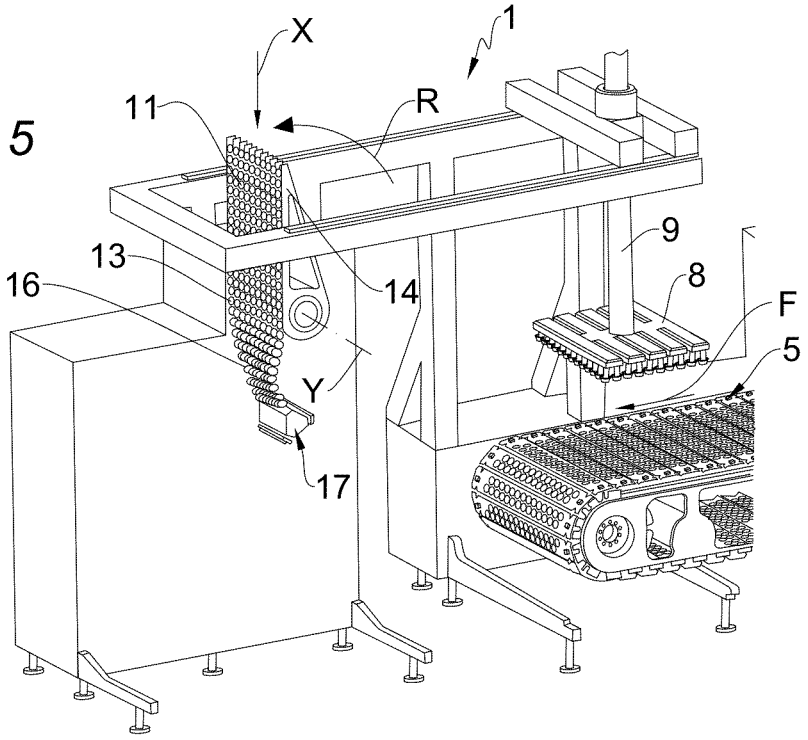
Figure 7:
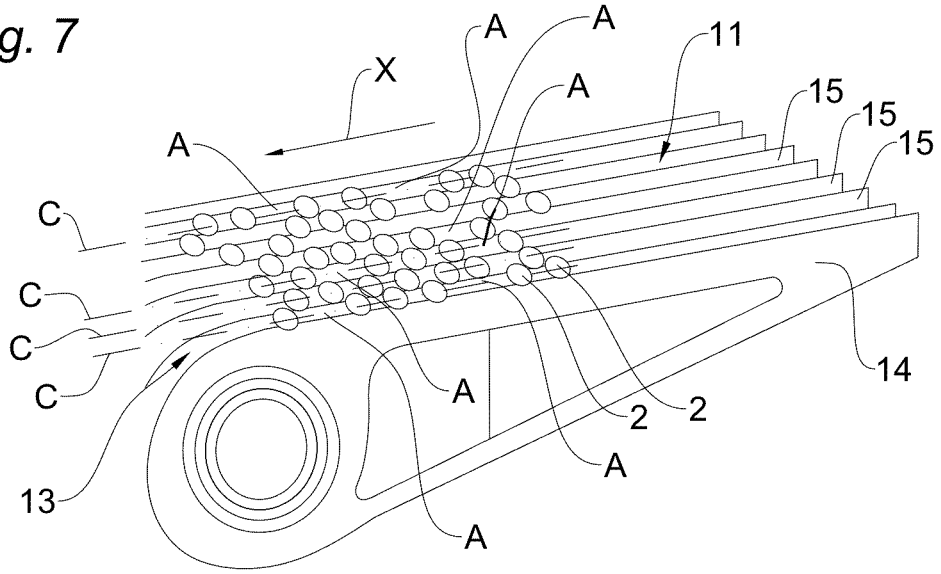

The movement member 12 is configured to make the plate 14 pivot about a rotation axis Y defined at the discharge end 13 between a first operating position, in which the support surface 11 is substantially horizontal (see FIG. 7), and a second operating position, in which the support surface 11 is inclined with respect to a horizontal plane through a predefined angle, which may be for example about 90°, as represented in FIG. 5.

Obviously, the inclination angle of the support surface 11 in the second operating position will be defined in the most appropriate manner, depending on the characteristics of the product 2 and the apparatus 1, provided that it makes the products 2 slide towards each other in the support surface 11 towards the discharge end 13. For example, the inclination angle of the support surface 11 in the second operating position may be lower than 90°, e.g. 70°.

The rotation axis Y is substantially perpendicular to the second advance direction X, so that the latter is substantially parallel to a direction of maximum slope of the support surface 11 when it is pivoted in the second operating position.

In alternative embodiments, the movement device 12 may be of another type suitable for moving the capsules 2 in the second advance direction X, such as belt or air-jet transporters.

The second conveyor 16 is positioned immediately downstream of the plate 14, so as to receive the capsules 2 coming from the discharge end 13.

The second conveyor 16 may be of any type suitable for transporting the capsules 2 in a third advance direction Z, which may or may not be distinct from the second advance direction X.

In the embodiment herein described, the second conveyor 16 comprises a plurality of guides G that are formed to appropriately position and orient the individual columns of capsules 2 coming from the channels 15 of the plate 14.

The guides of the second conveyor 16 are inclined downwards so that the capsules 2 may slide therein by gravity.

Downstream of the second conveyor 16, there is provided a packing device 17 which receives the capsules 2 and deposits them, in a predefined ordered configuration, inside the boxes 3.

The packing device 17 comprises a plurality of gripping devices 18, radially placed on a carousel 19 rotatable about a horizontal rotation axis.

For this purpose, each gripping device 18 may comprise a pair of grippers intended to laterally engage the row of capsules 2 being discharged from the second conveyor 16, at the protruding edges 2*c*. Each gripping device 18 is also advantageously provided with a radial movement, thus making it easier to either properly receive the capsules 2 being discharged from the second conveyor 16 and deposit them into the box 3.

The box forming and filling unit 20 comprises a carousel 21, having a horizontal rotation axis, provided with a plurality of equipment 22, radially extended from the carousel 21 and arranged to form, in cooperation with one or more members external to the carousel 21, a box 3 from a cardboard sheet 3*a*, suitably shaped and creased (called blank) supplied individually to an equipment 22 by a feeder 23.

Such operation of forming the box 3, providing for example folding subsequently the blank and gluing together respective panels at predefined points, is in itself well-known in the packaging machine sector and will therefore not be explained in further detail.

The carousel 21 is synchronously associated with the carousel 19 of the packing device 17, such that each row of capsules 2 taken from a gripping device 18 is deposited into a box 3, formed but not yet closed, brought at the gripping device 18 by a respective equipment 22 of the carousel 21.

The box forming and filling unit 20 also comprises a box closing station (not shown) which provides to close the box 3 after the capsules 2 have been inserted.

The production and packaging installation 100, with particular reference to its transporter apparatus 1, operates according to the following modes.

The empty capsules 2 are positioned in the seats 6 of the first conveyor 5, which provides to move them between the different workstations of the production apparatus 101 in the first advance direction F. In this way, the capsules 2 are first filled with coffee powder and then closed with a special membrane.

The seats 6 are arranged so as to form on the first conveyor 5 a plurality of rows which are substantially perpendicular to the first advance direction F. However, during the production step, one or more capsules 2 may not be present within the respective seat 6, or one or more capsules 2 may not comply with the production specifications such that they have been discarded or must be discarded at the end of the production step. In the latter case, for example, the capsules 2 to be discarded are not taken by the gripping head 8 and are dropped into a waste collection basket 5*a* appropriately provided at the end of the first conveyor 5.

These events may be due to many reasons, such as a jamming in the supply of empty capsules, or a malfunction of one or more of the devices for filling or closing the capsules 2.

In such cases, gaps A are formed on the first conveyor 5, i.e., seats 6 that are empty or occupied by non-compliant capsules 2 and therefore cannot be transported to the packaging apparatus 102.

At the end of this production step, the capsules 2, still carried by the first conveyor 5, are taken from the pick-up device 7 by the gripping head 8 (FIG. 1).

Figure 2:
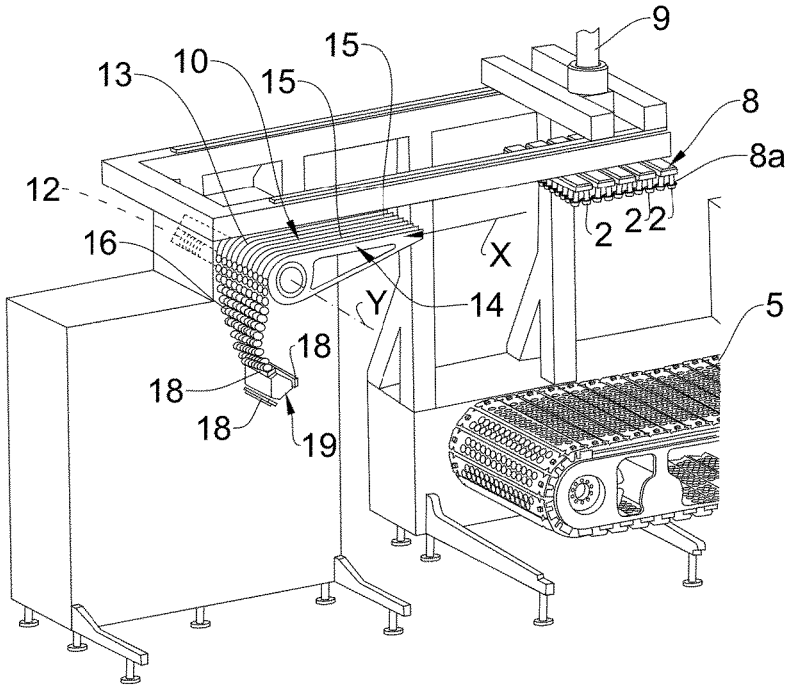
FIGS. 2 to 5 are side perspective schematic and partial views of the production and packaging installation of FIG. 1 with the transporter apparatus in subsequent operating configurations.
Figure 3:
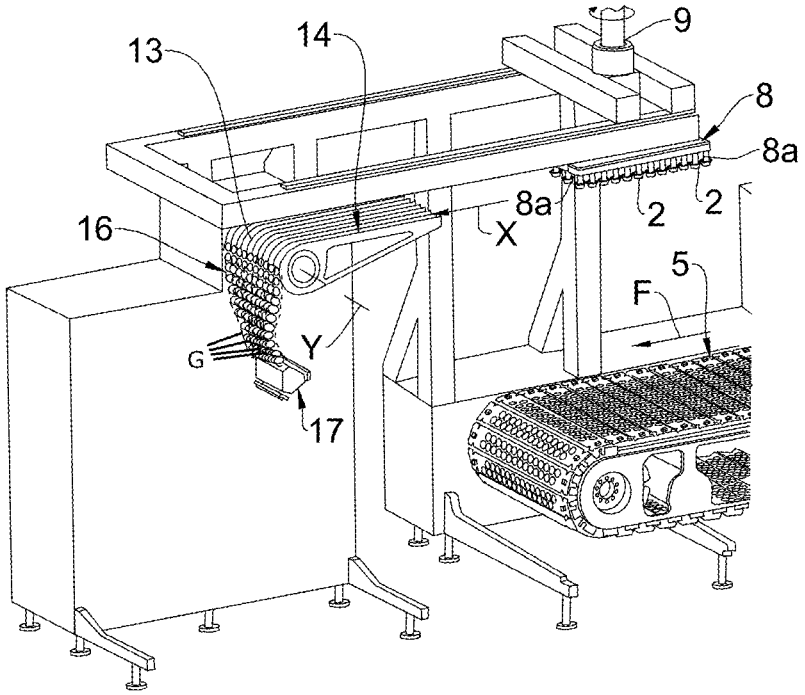
Figure 4:
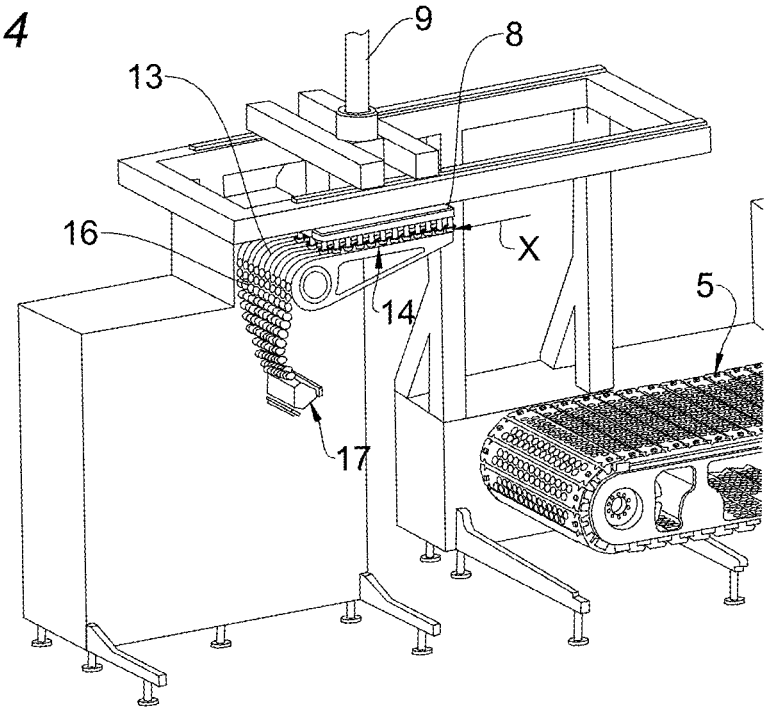

The latter is then raised by the arm 9 until it is at the height of the supply station 11 (FIG. 2), rotated by 90° so as to align the gripping elements 8*a* with the channels 15 (FIG. 3), moved over the plate 14 and finally lowered to deposit the capsules 2 inside the channels 15 of the plate 14 (FIG. 4). The capsules 2 deposited inside the channels 15 define respective columns C of capsules 2, substantially parallel to the second advance direction X.

In order to properly receive the capsules 2 deposited by the pick-up device 7, the plate 14 is maintained in the first operating position so that the support surface 11 is substantially horizontal (FIGS. 1-4 and FIG. 7).

It will be noted that in this step of transferring the capsules 2 from the first conveyor 5 to the plate 14, the gripping elements 8*a* intended to take a capsule 2 at a gap A remain empty, without the respective capsules 2.

In this way, the possible gaps A present on the first conveyor 5 are substantially carried over to the plate 14 (FIG. 7), so that within the channels 15 the columns C of the capsules 2 may not be compact.

Figure 8:
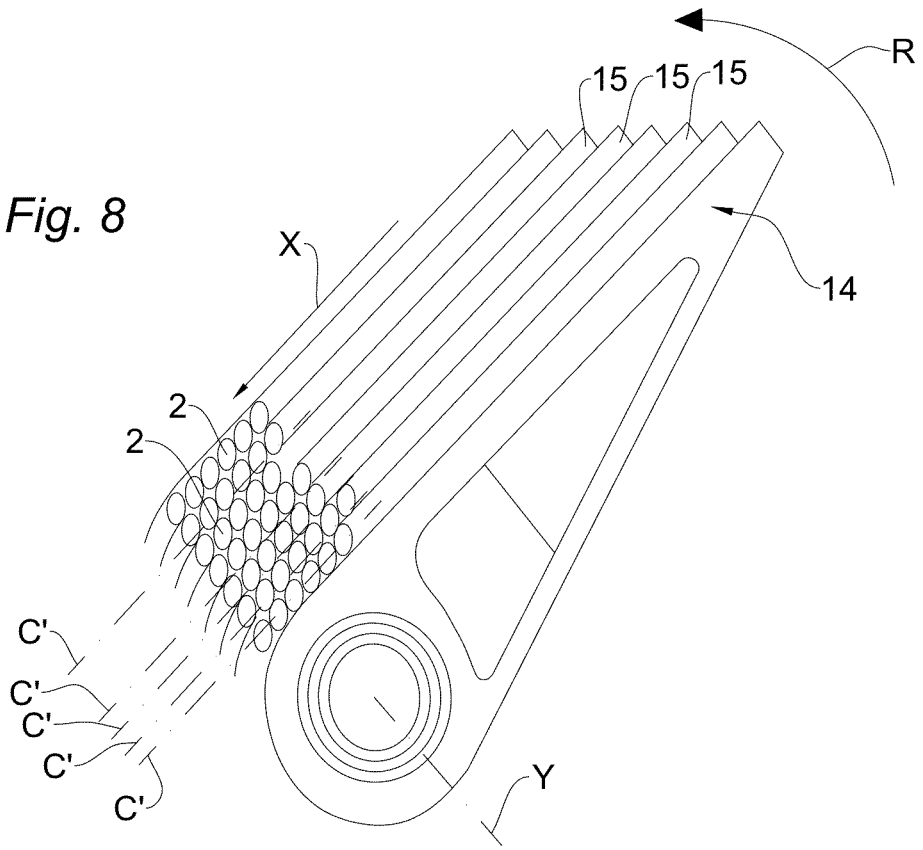

The plate 14 is then moved to the second operating position by rotating it about the rotation axis Y (FIG. 5). During this rotation, well exemplified in FIG. 8 by the arrow R, the plate 14 is inclined with respect to the horizontal plane causing the capsules 2 to slide in the second advance direction X defined by the channels 15 in which they are located.

In particular, each capsule 2 slides towards the discharge end 13 in the respective channel 15, until it comes to rest against a capsule 2 preceding it within the same column, so as to form a compact column C', free from gaps A.

The gaps A are then moved to the rear of their respective columns C', so that the length of each compact column C' also depends on the number of gaps A present in the starting column C.

Such smaller column length, however, may possibly be recovered from the capsules 2 brought to the plate 14 by the pick-up device 7 in the following working cycle.

The capsules 2 arrived at the discharge end 13 are then received by the second conveyor 16 which moves them in the third advance direction Z up to the packing device 17, where, each row of capsules 2 exiting the second conveyor 16 is taken by one of the gripping devices 18 and brought by the carousel 19 to a box 3, formed and opened, held by an equipment 22 of the carousel 21, within which it is deposited.

The box 3, containing the capsules arranged in the desired configuration, is then closed at the following box closing station and deposited on the transporter 30, which provides to bring it to the following stations.

It will therefore be noted that the rows of capsules 2 arriving at the packing device 17 from the second conveyor 16 are free from gaps A, so that the boxes 3 can be properly filled.

Thanks to the compaction unit 10, the transporter apparatus 1 therefore allows to obviate (at least to a limited extent) possible drawbacks that may occur during the production step of the capsules 2 and that may cause undesired gaps in the ordered configuration leaving the production apparatus 101.

Obviously, a person skilled in the art may, in order to meet specific and contingent application requirements, make further modifications and variants, all falling within the scope of protection as defined by the following claims.

The invention claimed is:

1. A transporter apparatus, for transporting products, comprising:

a first conveyor, comprising a plurality of seats thereon, which are suitable for receiving said products and which is provided to move said products in a first advance direction, a compaction unit which is positioned downstream of said first conveyor and comprising:

i. a support surface which is provided to receive said products from said first conveyor, ii. a movement member which is associated with said support surface and which is provided to move the products which are supported on said support surface towards each other in a second advance direction, thereby forming compact columns of products which are parallel with said second advance direction, a second conveyor which is positioned downstream of said compaction unit and which is provided to receive said compact columns of products and to move said compact columns of products in a third movement direction, wherein said movement member is configured to move said support surface between a first operating position, in which said support surface is substantially horizontal, and a second operating position, in which said support surface is inclined with respect to a horizontal plane.

2. The transporter apparatus according to claim 1, wherein in said second operating position, said support surface is inclined with respect to a horizontal plane through an angle greater than 30°.

3. The transporter apparatus according to claim 1, wherein said support surface is moved between said first position and said second position by being pivoted about a rotation axis which is defined in a region of a discharge end of said support surface.

4. The transporter apparatus according to claim 1, wherein said second advance direction is parallel to a maximum inclination direction of said support surface when said support surface is inclined in said second operating position.

5. The transporter apparatus according to claim 1, wherein in said first conveyor each of said seats is provided to receive one of said products.

6. The transporter apparatus according to claim 1, further comprising a gripping device provided to take said products from said first conveyor and to deposit them on said support surface.

7. The transporter apparatus according to claim 1, wherein said second conveyor comprises a plurality of guides, each one arranged to receive one of said compact columns of products.

8. An installation for producing and/or packaging products, comprising a transporter apparatus according to claim 1.

9. A transporter apparatus, for transporting products, comprising:

a first conveyor, comprising a plurality of seats thereon, which are suitable for receiving said products and which is provided to move said products in a first advance direction, a compaction unit which is positioned downstream of said first conveyor and comprising:

i. a support surface which is provided to receive said products from said first conveyor, ii. a movement member which is associated with said support surface and which is provided to move the products which are supported on said support surface towards each other in a second advance direction, thereby forming compact columns of products which are parallel with said second advance direction, a second conveyor which is positioned downstream of said compaction unit and which is provided to receive said compact columns of products and to move said compact columns of products in a third movement direction, wherein a plurality of channels are formed on said support surface, each of which is formed to receive a single column of said products.

10. The transporter apparatus according to claim 9, wherein said channels extend as far as said discharge end.

11. A transporter apparatus, for transporting products, comprising:

a first conveyor, comprising a plurality of seats thereon, which are suitable for receiving said products and which is provided to move said products in a first advance direction, a compaction unit which is positioned downstream of said first conveyor and comprising:

i. a support surface which is provided to receive said products from said first conveyor, ii. a movement member which is associated with said support surface and which is provided to move the products which are supported on said support surface towards each other in a second advance direction, thereby forming compact columns of products which are parallel with said second advance direction, a second conveyor which is positioned downstream of said compaction unit and which is provided to receive said compact columns of products and to move said compact columns of products in a third movement direction, wherein said second conveyor comprises a plurality of guides, each one arranged to receive one of said compact columns of products and wherein said plurality of guides supply a packing device for said products.

12. A method for transporting products in a production apparatus and/or packaging apparatus for said products, the method comprising:

arranging said products inside seats which are arranged on a first conveyor and moving said products in a first advance direction of said first conveyor, transferring a plurality of said products from said seats and depositing the plurality of said products on a support surface which is substantially horizontal, arranging said plurality of products on said support surface in columns which are parallel with a second advance direction which is defined on said support surface wherein a plurality of channels are formed on said support surface, each of which is formed to receive a single column of said products, applying a force to said products so as to move them on the support surface towards each other in said second advance direction so as to form a plurality of compact columns of products, and receiving said compact columns of products and moving said compact columns in a third advance direction .

13. The method according to claim 12, wherein said products are moved on said support surface in said second advance direction by inclining said support surface towards a discharge end of said support surface.

14. The method according to claim 13, wherein said support surface is inclined by rotating said support surface about a rotation axis which is perpendicular to said second advance direction.

* * * * *